US005775548A

United States Patent [19]

Hohmann et al.

[11] Patent Number: 5,775,548

[45] Date of Patent: Jul. 7, 1998

[54] UPRIGHT/INVERTED SPRAYER

[75] Inventors: Thomas Hohmann, Hemer; Ingo Schäfer, Lüdenscheid, both of Germany

[73] Assignee: Calmar Inc., City of Industry, Calif.

[21] Appl. No.: 861,624

[22] Filed: May 22, 1997

Related U.S. Application Data

[63] Continuation-in-part of Ser. No. 848,030, Apr. 28, 1997, Pat. No. 5,738,252.

[51] Int. Cl.[6] ..... B67D 5/40

[52] U.S. Cl. ..... 222/376; 222/382; 222/481.5

[58] Field of Search ..... 222/376, 382, 222/383.1, 402.19, 321.4, 481.5

[56] References Cited

U.S. PATENT DOCUMENTS

| | | | |
|---|---|---|---|
| 2,793,794 | 5/1957 | Samuel | 222/376 |
| 2,904,229 | 9/1959 | Sameul | 222/376 |
| 5,462,209 | 10/1995 | Foster et al. | 222/376 |
| 5,738,252 | 4/1998 | Dodd et al. | 222/376 |

*Primary Examiner*—Philippe Derakshani

*Attorney, Agent, or Firm*—Watson Cole Grindle Watson, P.L.L.C.

[57] ABSTRACT

A manually actuated liquid pump sprayer is capable of use in both upright and inverted positions without leakage through the vent port by the provision of a first slider valve which covers an inlet port in the upright position and which uncovers that port when the pump is inverted. A second slider valve located within the pump body is provided for uncovering the vent port in the upright position of spray, and for covering that vent port in the inverted position to avoid leakage.

6 Claims, 1 Drawing Sheet

UPRIGHT/INVERTED SPRAYER

RELATED APPLICATION

This application is a continuation-in-part of application Ser. No. 08/848,030, filed Apr. 28, 1997 now U.S. Pat. No. 5,738,252 in the names of Joseph K. Dodd and John P. McKernan, entitled Upright/Inverted Sprayer.

BACKGROUND OF THE INVENTION

This invention relates generally to a sprayer capable of being effectively operated during pumping in both upright and inverted positions without leakage through the container vent passage which, according to the invention, is sealed closed in the inverted position by the provision of a separate slider valve.

Dispensers are known as having a slide valve which in an upright position during the dispensing operation closes an auxiliary inlet port in the primary inlet passage leading to the pump chamber. In an inverted position of the dispenser, the slider valve uncovers that inlet port, located near the upper end of the container, thereby admitting product into the primary inlet passage to effect dispensing while inverted.

U.S. Pat. Nos. 4,019,661 and 2,792,974 and Australian patent 208597 disclose slide valves for dispensers generally as aforedescribed. However, none of these slider valves functions to close the vent passage during inverted spray to avoid leakage of product through the vent.

SUMMARY OF THE INVENTION

It is an object of the present invention to provide a manually actuated liquid pump sprayer capable of being operated in both upright and inverted positions, without leakage, by the provision of first and second slider valves, the first covering the inlet port of the auxiliary liquid inlet passage which leads to the primary inlet passage, in an upright sprayer position, and uncovering that port in an inverted position to permit spray irrespective of the attitude of the sprayer.

The second slider or shuttle valve according to the invention, is located within the pump body for covering a vent port in an inverted position of the sprayer to avoid leakage along a vent passage and through that port when spraying in a position other than substantially upright.

The second slider valve is guided within a vent passage of the pump body without rotation about its central axis to assure vent port closing effectively and quickly during each inverted spray. The vent passage has opposing flat walls, and the second slider valve is complementarily shaped. The vent passage having such guide is an existing structure thereby requiring no modification and retooling of the improved pump sprayer according to the invention.

Other objects, advantages and novel features of the invention will become more apparent from the following detailed description of the invention when taken in conjunction with the accompanying drawings.

DETAILED DESCRIPTION OF THE INVENTION

Figure 1:
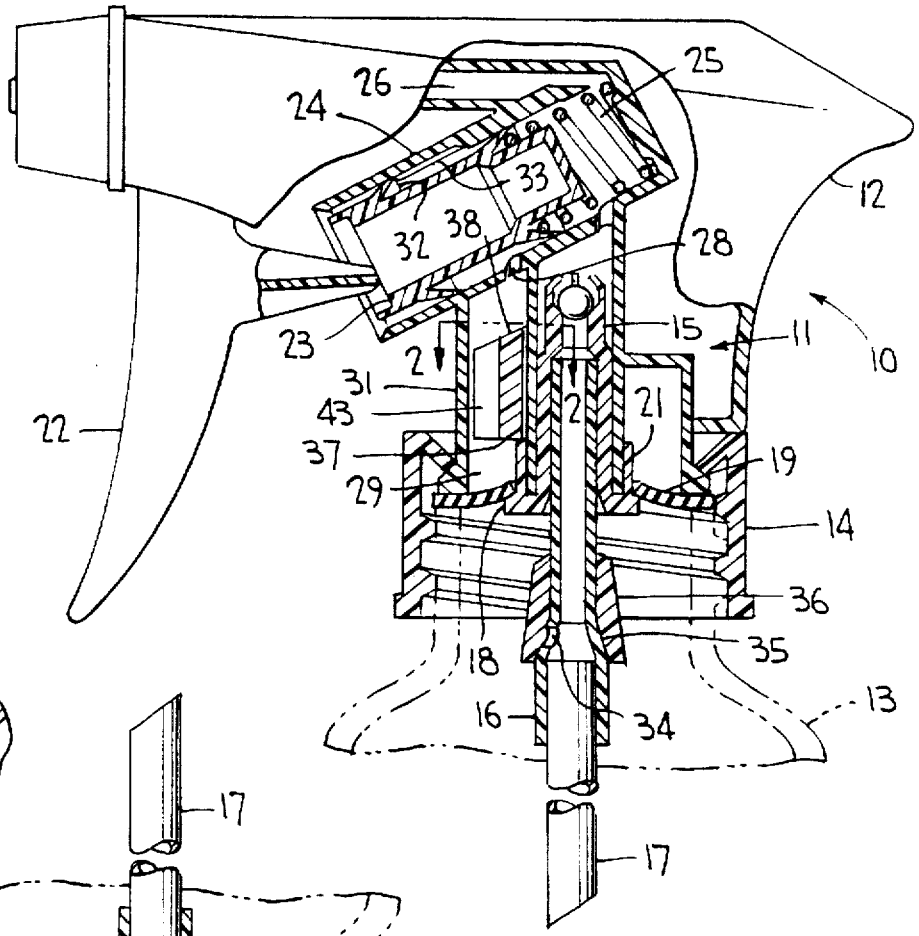
FIG. 1 is a side elevational view, mostly in section, of an upright trigger sprayer incorporating the invention.
Figure 3:
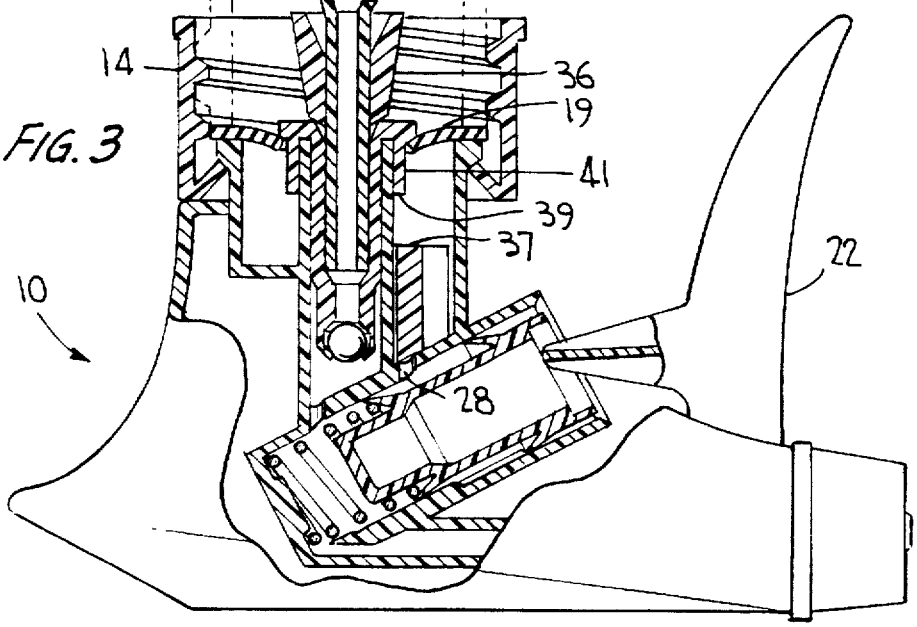
FIG. 3 is a view similar to FIG. 1 of the trigger sprayer in its inverted position with the vent port closed.

Turning now to the drawings wherein like reference characters refer to like and corresponding parts throughout the several views, a trigger sprayer generally designated 10 in FIG. 1 has a pump body 11 which is essentially the same as that illustrated in FIG. 3 of parent application Ser. No. , and as disclosed in U.S. Pat. Nos. 4,747,523 and 5,507,418, commonly owned herewith. The pump body is covered by a shroud 12, and is mounted in the normal manner on the neck of a container 13 by a provision of a closure cap 14. A tube retainer 15 is fixed to the pump body, and suspends a tube adapter 16 which in turns suspends a dip tube 17 extending into the interior of container 13 as in the manner known in this art.

Tube retainer 15 has an external flange 18 for supporting gasket seal 19 at a central opening 21 thereof. Similarly as disclosed in the U.S. Pat. No. 5,507,418, opening 21 is rectangular such that, when surrounding the circular portion of the lower end of tube retainer 15, four ports are formed at the four corners of the rectangular central opening.

A trigger actuator 22 is hingedly mounted to the pump body in the normal manner, and functions to reciprocate pump piston 23 within its cylinder bore 24 for the dispensing of liquid from pump chamber 25 through discharge passage 26 and out through the discharge orifice located in nozzle cap 27. The pump cylinder has a vent port 28 forming part of a vent passage 29 extending through a hollow section 31 of the pump body (see also FIG. 2) and communicating with the interior of the container via the ports established in the gasket seal at the four corners as aforedescribed. The vent passage is open to the atmosphere during pumping as a vent seal 32 on the piston is deformed during each pressure stroke as it is juxtaposed to one or more longitudinal vent ribs 33 located on the inner wall of the cylinder bore, as described in more detail in the U.S. Pat. No. 4,545,523.

An auxiliary liquid inlet passage is established by the provision of an inlet port 34 located in tube adapter 16 at frusto-conical section 35 thereof and in the vicinity of the upper end of the interior of the container.

A first slider valve 36, in the form of a sleeve having a frusto-conical section which matches that of section 35, surrounds tube adapter 16 for sliding movement therealong between the FIG. 1 and FIG. 3 positions. In the upright position of FIG. 1, the lower portion of slider valve 36 tightly engages frusto-conical section 35 to cover inlet port 34 such that product during each suction stroke inlets to the pump chamber via the dip tube and through the tube adapter which together comprise a primary liquid inlet passage.

A second slider valve 37 is, according to the invention, provided within the pump body. Specifically, slider or shuttle valve 37 is mounted for sliding movement within vent passage 29 which is delimited by hollow section 31 of the pump body (see also FIG. 2). Upper end 38 of valve 37 is concave and is sloped to match that of cylinder 24. And end 39 of outer flange 41 of tube retainer 15 is located in the path of valve 37 and functions as a limit stop for maintaining the valve in its FIG. 1 position.

Figure 2:
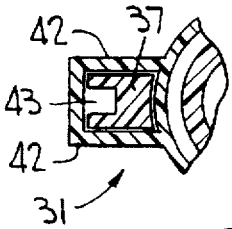
FIG. 2 is a sectional view taken substantially along the line 2—2 of FIG. 1.

As shown in FIG. 2, valve 37 has opposing flat sides confronting opposing flat side walls 42 of section 31 to avoid any rotation of valve 37 about its central axis during its sliding movement. And, the valve may have a longitudinal cutout 43 at one end to maintain uninterrupted air flow through the open vent passage into the container in the FIG. 1 position.

While pumping during an inverted attitude of the trigger sprayer, second slider valve 37 shifts under gravity until its concaved and sloped end 38 bears against the confronting convexed and sloped surface of the pump cylinder to thereby cover vent port 28. Since the vent port is in alignment with the solid portion of valve 37, the vent passage is thereby closed as shown in FIG. 3, while inlet port 34 is uncovered as valve 36 shifts into its vent port open condition of FIG. 3 under gravity.

From the foregoing it can be seen that a simple and efficient yet highly effective valve arrangement to facilitate upright and inverted spray has been devised by the provision of independent slider valves, one for covering and uncovering an inlet port respectively during upright and inverted spray, and the other for uncovering and covering the vent port respectively during upright and inverted spray. Since the pump body need not be modified to accommodate second slider valve 37, and since the gasket seal is the same as in the prior art, the cost of adapting the known trigger sprayer to inverted spray is minimal. In addition to the slider valves, the only additional part required is a tube adaptor.

Obviously, many other modifications and variations of the present invention are made possible in the light of the above teachings. It is therefore to be understood that within the scope of the appended claims the invention may be practiced otherwise than as specifically described.

What is claimed is:

1. A manually actuated liquid pump sprayer capable of spraying during pumping in an upright position and in an inverted position, comprising a pump body having means for mounting the body to a container of liquid to be dispensed, said body having a pump chamber, means defining a primary liquid inlet passage extending to said chamber and means defining a liquid discharge passage extending from said chamber, the sprayer having a container vent passage including a vent port establishing communication between an interior of the container and the atmosphere during operation of the sprayer in the upright position, an auxiliary liquid inlet passage including an inlet port extending between the interior of the container at an upper end thereof and said primary passage, the improvement wherein a slider valve is mounted on said primary inlet passage means for sliding movement for blocking the inlet port in the upright position, and a second slider valve within said pump body for blocking the vent port in the inverted position.

2. The dispenser according to claim 1, wherein said vent port is located in a pump cylinder wall of said pump body, said second slider valve being slidable within said vent passage for covering and uncovering said vent port in said inverted and upright positions, respectively.

3. The dispenser according to claim 1, wherein said primary inlet passage means comprises a retainer for suspending a dip tube extending into the container, said first slider valve comprising a sleeve covering said inlet port in said upright position.

4. The dispenser according to claim 2, wherein said vent passage includes means for guiding said second slider valve during its sliding movement.

5. The dispenser according to claim 4, wherein said pump body has a limit stop in the path of said second slider valve for limiting travel of said second slider valve away from said vent port in said upright position.

6. The dispenser according to claim 4, wherein said guide means comprises a hollow section of said pump body having opposing flat walls, said second slider valve having opposing sides parallel to said flat walls.

* * * * *